United States Patent [19]

Frank et al.

[11] 4,409,643

[45] Oct. 11, 1983

[54] LONG LIFETIME, LOW INTENSITY LIGHT SOURCE FOR USE IN NIGHTTIME VIEWING OF EQUIPMENT MAPS AND OTHER WRITINGS

[75] Inventors: Alan M. Frank, Livermore; William R. Edwards, Modesto, both of Calif.

[73] Assignee: The United States of America as represented by the U.S. Department of Energy, Washington, D.C.

[21] Appl. No.: 360,966

[22] Filed: Mar. 23, 1982

[51] Int. Cl.[3] ..... F21L 7/00

[52] U.S. Cl. ..... 362/157; 362/186; 362/208; 362/800

[58] Field of Search ..... 362/157, 186, 208, 800

[56] References Cited

U.S. PATENT DOCUMENTS 4,290,095 9/1981 Schmidt ..... 362/800

4,310,873 1/1982 Bean ..... 362/800

*Primary Examiner*—Stephen J. Lechert, Jr.

*Attorney, Agent, or Firm*—Miguel A. Valdes; Clifton E. Clouse, Jr.; Richard G. Besha

[57] ABSTRACT

A long-lifetime light source with sufficiently low intensity to be used for reading a map or other writing at nighttime, while not obscuring the user's normal night vision. This light source includes a diode electrically connected in series with a small power source and a lens properly positioned to focus at least a portion of the light produced by the diode.

5 Claims, 1 Drawing Figure

LONG LIFETIME, LOW INTENSITY LIGHT SOURCE FOR USE IN NIGHTTIME VIEWING OF EQUIPMENT MAPS AND OTHER WRITINGS

BACKGROUND OF THE INVENTION

The Government has rights in the invention disclosed herein which arose under, or in the course of, U.S. Department of Energy Contract No. W-7405-ENG-48 with the University of California.

The present invention relates to light sources; particularly, it relates to long-lifetime light source with sufficient low intensity so as to be used for nighttime reading of maps and documents without obscuring the user's normal night vision.

One device in the prior art, which is related to the subject invention, uses a prism to project light of a desired color onto an object, as described in U.S. Pat. No. 1,810,669 to Loeb. Another known device discloses a flashlight which passes only light of shorter wavelengths by using a filter, as described in U.S. Pat. No. 2,304,742 to Officer et al. Another known prior art device discloses a filter arrangement for a photographic flash that uses only infra-red light, is described in U.S. Pat. No. 2,342,470 to Hunt. Still another prior device discloses a combination writing instrument, as described in U.S. Pat. No. 4,168,521 to Bajusz. There is a need at present for a device to read maps and other writings at nighttime without obscuring the user's normal night vision. For example, a person driving a car during the night may use such an invention to read a road map.

This and other unique problems require a low intensity visible light focused very closely to the map or writing to be examined.

It is, accordingly, a general object of the invention to provide a long-lifetime light source with sufficiently low intensity.

Another object of the invention is to provide a light source with a lens having a suitable focal length to allow it to be used close to a map or writing to be examined.

Other objects, advantages and novel features of the invention will be apparent to those of ordinary skill in the art upon examination of the following detailed description and the accompanying drawing of a preferred embodiment of the invention.

SUMMARY OF THE INVENTION

The invention comprises a light source for nighttime use, which includes a power source, a light-emitting diode connected electrically to that source in a circuit and chosen to produce a visible wavelength light in response to the flow of a small support across the diode and a lens with suitable focal length positioned adjacent to the diode to focus a portion of the light produced by the diode.

An important difference between the invention and the devices of the prior art is the use of a light-emitting diode in a simple arrangement. This invention has the advantage of providing a long-lifetime light source with a very low intensity. Another advantage of the invention is that the lifetime of the light source may be increased by controlling the current flow across the diode with a small resistor connected in the battery-diode circuit.

BRIEF DESCRIPTION OF THE DRAWINGS

The single FIGURE is a schematic view, including a circuit diagram, of the invention.

DESCRIPTION OF A PREFERRED EMBODIMENT

Figure 1:
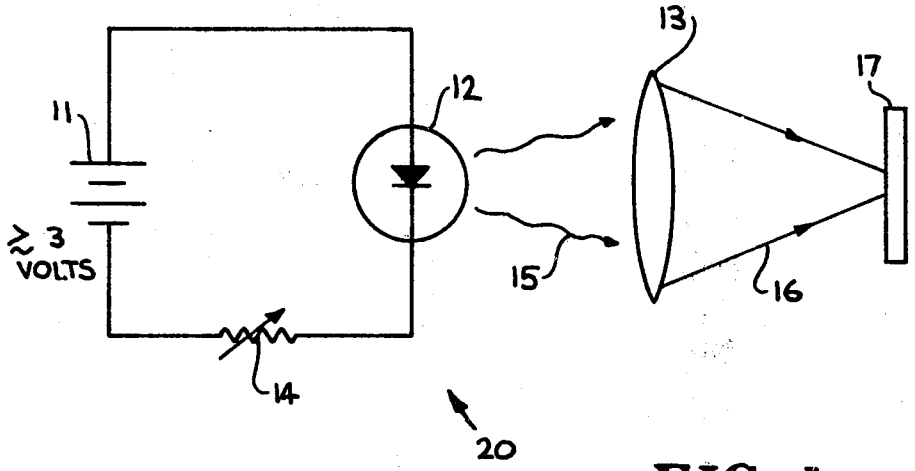

Reference will now be made in detail to the preferred embodiment of the present invention, example of which is illustrated in the accompanying drawing.

While the invention will be described in connection with a preferred embodiment, it will be understood that it is not the intention to limit the invention to that embodiment. On the contrary, it is intended to cover all alternatives, modifications and equivalents, as may be included within the scope of the invention defined in the appended claims.

Referring to the drawing, a small power source 11, such as a three-volt battery (or two $1\frac{1}{2}$ volt penlight batteries in series) is connected in series with a conventionally known diode 12 to produce a low intensity visible light 15. The light 15 may be in a desired light spectrum range, for example red. This light 15 will be produced in response to the passage of current, approximately 25 milliamperes, across a light-emitting diode 12. To focus and direct at least a portion of the light produced by diode 12, a lens 13 is properly positioned adjacent to diode 12 to produce a light beam 16. Lens 13 may have a focal length of 1 to 2 centimeters in order to direct the light beam 16 close to a map or other writing, indicated as 17, to be examined. The lifetime of the power source 11 is about twenty to twenty-five hours with constant use and about forty hours if used intermittently. The current flow across diode 12 may be reduced or controlled by including a small variable resistor 14 in series with diode 12 and power source 11. However, this will reduce the intensity of the light 15 produced by this invention.

The foregoing description of a preferred embodiment of the invention has been presented for purposes of illustration and description and is not intended to be exhaustive or to limit the invention to the precise form disclosed. The embodiment was chosen and described in order to best explain the principles of the invention and their practical application to thereby enable others skilled in the art to best utilize the invention in various embodiments and with various modifications as are suited to the particular use contemplated.

What is claimed is:

1. A low intensity, long-lifetime continuous light source for nighttime use for low intensity illumination of maps and documents to enable reading time without obscuring normal night vision, which comprises:

a power source;

a diode, electrically connected in series to said power source, for producing visible wavelength light in response to a small current through said diode from said power source;

a lens positioned adjacent to said diode to focus at least a portion of said diode light, said lens having a focal length in the range of 1 to 2 centimeters; and means electrically connected in series with said power source and said diode so as to reduce the intensity of the light produced by said diode by controlling the current through said diode.

2. A light source as recited in claim 1, wherein said power source consists of a 3 volt battery.

3. A light source as recited in claim 1, wherein said power source consists of two 1–5 volt penlight batteries.

4. A light source as recited in claim 1, wherein said visible wavelength light is in the red spectrum range.

5. The light source of claim 1, wherein said means is a variable resistor.

* * * * *